US006540580B1

(12) United States Patent
Wolfram

(10) Patent No.: US 6,540,580 B1
(45) Date of Patent: Apr. 1, 2003

(54) YO YO HAVING REMOVABLE TOY FIGURES AND CONTAINER PLAYSET

(75) Inventor: David G. Wolfram, Hermosa Beach, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/489,251

(22) Filed: Jan. 21, 2000

(51) Int. Cl.[7] ..... A63H 1/30

(52) U.S. Cl. ..... 446/250; 446/251; 446/314; D21/465

(58) Field of Search ..... 446/250, 251, 446/315, 314; D21/465

(56) References Cited

U.S. PATENT DOCUMENTS

| | | | | |
|---|---|---|---|---|
| 1,136,454 | A | | 4/1915 | Warren |
| 1,710,679 | A | | 4/1929 | Pels |
| 2,676,432 | A | * | 4/1954 | Field |
| 3,089,277 | A | * | 5/1963 | Reese |
| 3,256,635 | A | * | 6/1966 | Rodovan |
| D232,956 | S | | 9/1974 | Chelman |
| 3,895,457 | A | * | 7/1975 | Koskiewicz |
| 4,081,924 | A | | 4/1978 | Fabricant |
| 4,332,102 | A | | 6/1982 | Caffrey |
| 4,575,348 | A | * | 3/1986 | Wiggs et al. ..... 446/310 |
| 4,946,413 | A | | 8/1990 | Lehmann et al. |
| 4,964,831 | A | | 10/1990 | Wolff |
| 5,013,278 | A | | 5/1991 | Dixon et al. |
| 5,064,398 | A | | 11/1991 | Richardson |
| 5,152,710 | A | | 10/1992 | Montgomery |
| 5,310,375 | A | * | 5/1994 | Kanauchi ..... 446/71 |
| 5,480,335 | A | | 1/1996 | Caveza |
| D382,919 | S | * | 8/1997 | Calvin |

FOREIGN PATENT DOCUMENTS

| | | | | |
|---|---|---|---|---|
| FR | 746299 | * | 3/1933 | ..... 446/250 |
| FR | 912890 | * | 8/1946 | ..... 446/251 |

* cited by examiner

*Primary Examiner*—Jacob K. Achun
*Assistant Examiner*—Bena B. Miller
(74) *Attorney, Agent, or Firm*—Roy A. Ekstrand

(57) ABSTRACT

A yo yo toy is formed of a pair of substantially disk-shaped body halves joined in a spaced arrangement by a center shaft. A quantity of string is secured to the center shaft and wound within the space. Each body half includes a receptacle and a cover pivotally secured thereto and lachable in a closed position. A plurality of toy items are secured within the receptacle and cover of one body half while the remaining body half defines a play feature background and play surface for the toy figure in the open position.

3 Claims, 1 Drawing Sheet

YO YO HAVING REMOVABLE TOY FIGURES AND CONTAINER PLAYSET

FIELD OF THE INVENTION

This invention relates generally to Yo yo toys and particularly to those having an additional play or amusement feature.

BACKGROUND OF THE INVENTION

Yo yo toys have proven to be a long standing and well known toy product. The basic components of a Yo yo are simple and generally comprise a body usually formed of a pair of generally disk-like body halves joined by a center shaft. The body halves are spaced apart slightly to form a center space therebetween. A string has one end secured about the center shaft and the remaining end configured to be looped around the user's fingers with a slip knot or the like. The attachment of the string end to the center shaft of the Yo yo is carried forward in either a fixed attachment or a loop formed to encircle the center shaft.

In a typical Yo yo play pattern, the outer end of the string is secured to the user's finger and the string is wound upon the center shaft until the Yo yo body is received within the user's hand. Thereafter, the user simply throws the Yo yo body downwardly which unwinds the string as the Yo yo body falls simultaneously spinning the body. At the full extension of the string, the spinning momentum of the Yo yo body rewinds the string and raises the Yo yo upwardly upon the string to be caught in the user's hand. For those Yo yo's of the type having a fixed attachment of the string end upon the center shaft this simple up and down pattern is repeated and constitutes the extent of play with some variation of use.

A substantially greater flexibility of use and amusement is provided by Yo yo's in which the string end at the center shaft of the Yo yo is simply looped about the center shaft. This allows the spinning Yo yo body to spin within the string loop at the bottom extension of the string and greatly increase the flexibility of toy play pattern. Thus, as the user throws the Yo yo body downwardly unwinding the string and spinning the Yo yo it continues to spin at the bottom end of the string allowing various tricks to be performed. The user raises the spinning Yo yo body by imparting a sharp tug to the string which wraps and binds the lower end of the spring upon the shaft and raises the Yo yo.

Notsurprisingly, the extended popularity of Yo yo toys have prompted practitioner's in the art to provide a great variety of such toys. For example, U.S. Pat. No. 2,676,432 issued to Field sets forth a WHIRLING TOY having a Yo yo defining a pair of body halves and a string secured to the center shaft therebetween. Each body half defines a clear outer surface and a cavity within which a toy figure is rotatably supported.

U.S. Pat. No. Des. 232,956 issued to Chelman sets forth a YO YO TOY having a Yo yo body formed by a symmetrical mirror image pair of body portions and a center shaft therebetween. Each body portion supports a clear dome enclosure within which a plurality of toy items are captivated and moveable.

U.S. Pat. No. Des. 382,919 issued to Calvin sets forth a YO-YO having a pair of disk-like body halves joined by a center shaft and having a string secured thereto. Each body half is transparent and receives a toy figure therein. The toy figure is viewable through the transparent body halves.

U.S. Pat. No. 4,081,924 issued to Fabricant sets forth a YO YO TOY CARRYING AN ADDITIONAL MEMBER having a Yo yo body formed by a pair of spaced apart disk-shaped body halves and a center shaft therebetween. A string is wound about the center shaft and is tied to a finger loop at its outer end. A bracket is rotatably secured to the body halves and extends above and across the body halves. An aperture in the bracket allows the string to pass therethrough between the center shaft and the finger ring. A toy figure is supported upon the bracket.

U.S. Pat. No. 4,332,102 issued to Caffrey set forth a SUPERIOR PERFORMANCE YO YO providing increased spinning time for performing tricks. The Yo yo string is attached to a free spinning baring surrounding the center axle. The baring is operable connected to centrifugal actuated spring loaded clutch mechanism.

Anther interesting type of toy product enjoying substantial popularity through the years is found through container/play housing toys. In such toys, the toy container also functions as a play environment for the toys removably stored within the container. For example, U.S. Pat. No. 5,480,335 issued to Caveza sets forth a TOY FOR MAKING SIMULATED FRENCH FRIES FROM CHEWING GUM STICKS having a pair of container halves joined by a hinge and movable between opened and closed positions. A plurality of simulated food making toy items are supported within the container for storage and attachable to the container halves when open for play.

U.S. Pat. No. 4,575,348 issued to Wiggs et al. sets forth an OPENING CASE TOY OR AMUSEMENT DEVICE in which a case houses an internal figure. The case is closed to hide the figure and is open to allow a spring mechanism to raise the figure to a play position.

U.S. Pat. No. 1,710,679 issued to Pels sets forth a COMBINATION FIGURE TOY AND PAINT BOX having a toy figure generally resembling a human and having a spherical torso. The spherical torso includes a pair of hemispherical portions hingedly joined to allow the toy body to be opened and reveal a paint box supported therein.

U.S. Pat. No. 5,310,375 issued to Kanauchi sets forth a SMALL DECORATION EQUIPT WITH SPRING OPERATED MOVABLE DECORATIVE ELEMENT having a pair of container portions hingedly coupled to define an interior cavity within which miniature toy figures are received. U.S. Pat. No. 5,013,278 issued Dixon et al. sets forth a DIORAMA TOY KIT while U.S. Pat. No. 4,964,831 issued to Wolff sets forth a COLLECTOR ADDITION DOLL and U.S. Pat. No. 5,064,398 issued to Richardson sets forth a CARRYING CASE FOR PEA CHARACTERS all of which generally shown toy carrying cases which open to provide a play environment.

Additional opening play sets are shown in U.S. Pat. No. 5,152,710 issued to Montgromery and entitled FOLD OPEN PLAY SET WITH SLOTTED BASE; U.S. Pat. No. 1,136,454 issued to Warren entitled FOLDING BOX; and U.S. Pat. No. 4,946,413 issued to Lehmann et al. entitled MULTI USE TOY.

While the foregoing described prior art devices have generally improved the art and in some instances enjoyed commercial success, there remains nonetheless a continuing need in the art for evermore varied, interesting and amusing Yo yo type toy products.

SUMMARY OF THE INVENTION

Accordingly, it is a general object of the present invention to provide a more amusing and entertaining Yo yo type toy. It is a more particular object of the present invention to provide an improved Yo yo type toy which employs additional supplementary play features for obtaining increased amusement.

In accordance with the present invention there is provided a Yo yo toy comprising: a pair of body halves each having a receptacle and a cover, the covers each movable between and open configuration and a closed configuration, the covers and the receptacles defining cavities in the closed configuration; a center shaft supporting the body halves to define a space therebetween; a string having one end extending into the space and being wound upon the center shaft; and at least one toy item removably secured within one of the cavities.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
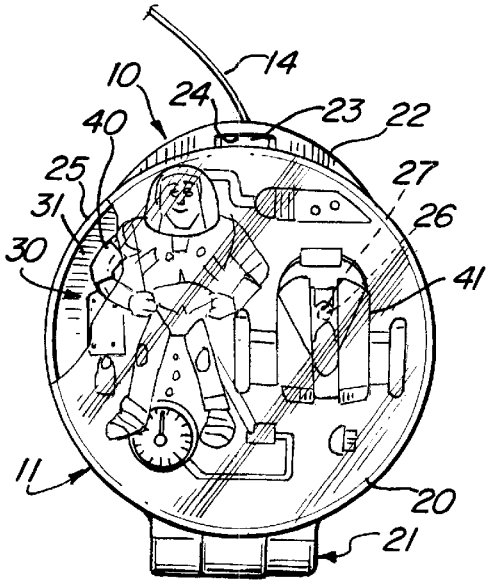
FIG. 1 sets forth a side elevation view of a Yo yo toy constructed in accordance with the present invention.

FIG. 1 sets forth a side elevation view of a Yo yo toy constructed in accordance with the present invention and generally referenced by numeral 10. Yo yo 10 includes a pair of body halves 11 and 12 (body half 12 shown in FIG. 2). As is better seen in FIG. 2, body halves 11 and 12 are joined by a center shaft 15 and are separated thereon to form a space 13 between body halves 11 and 12. As is also better seen in FIG. 2, a string 14 is received within space 13 and is secured to shaft 15 by conventional attachment (not shown).

Returning to FIG. 1, Yo yo 10 includes a receptacle 25 having a support surface 31 together with a transparent cover 20. Transparent cover 20 is preferably formed of a clear plastic material or the like and is pivotally joined to receptacle 25 by a conventional hinge 21. Receptacle 25 further supports a snap-clasp 22 having an aperture 23 formed therein. Correspondingly, transparent cover 20 defines a snap-tab 24 receivable within aperture 23 to secure transparent cover 20 in the closed position shown.

Figure 2:
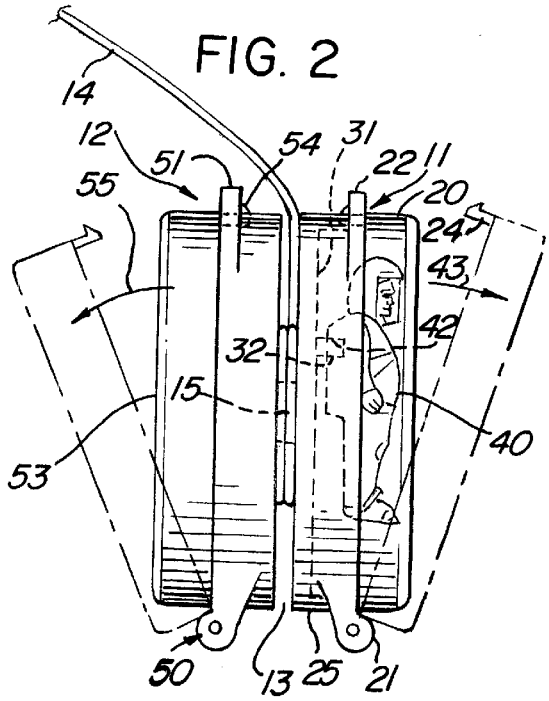
FIG. 2 sets forth a side elevation view of the improved Yo yo toy of FIG. 1.

In accordance with an important aspect of the present invention, a toy figure 40 and a figure accessory 41 are received within container cavity 30 formed between support surface 31 and transparent cover 20. In further accordance with the present invention, toy figure 40 and toy figure accessory 41 are releasably secured to support surface 31. The support mechanism for toy figure 40 is shown in FIG. 2 in greater detail. The support mechanism for figure accessory 41 includes a rearwardly extending post 26 which is received within an aperture 27 formed in support surface 31. Thus, post 26 is received within aperture 27 to releasably secure figure accessory 41.

In the closed position shown in FIG. 1, the user is able to utilize Yo yo 10 upon string 14 in accordance with conventional Yo yo play patterns.

FIG. 2 sets forth a side elevation view of Yo yo 10 in the closed configuration. FIG. 2 also shows dash-line representations of the cover portions (covers 20 and 53) pivoting outwardly about their respective hinges toward the open configuration of the present invention Yo yo. Yo yo 10 includes a pair of body halves 11 and 12 supported in a spaced arrangement upon a center shaft 15. Thus, a space 13 is formed between body halves 11 and 12. Correspondingly, a string 14 is received within space 13 and is secured to center shaft 15 by conventional attachment (not shown). Body half 11 includes a receptacle 25 having a support surface 31 and a snap-clasp 22 formed thereon. Body half 11 further includes a transparent cover 20 joined to receptacle 25 by a hinge 21. Transparent cover 20 further includes a snap-tab 24 which is forced through aperture 23 (seen in FIG. 1) of snap-clasp 22 to secure transparent cover 20 in the closed position shown.

Figure 3:
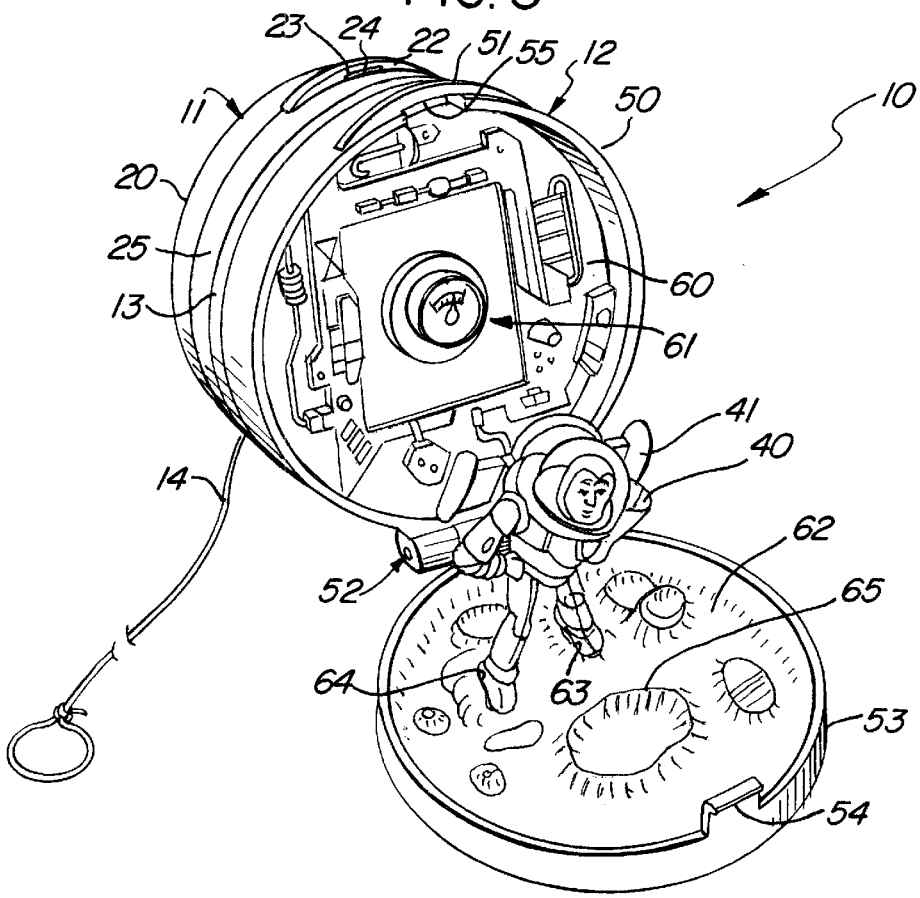
FIG. 3 sets forth a perspective view of the present invention Yo yo toy in its open configuration.

Body half 12 includes a receptacle 50 having a snap-clasp 51 which in turn defines an aperture 55 (seen in FIG. 3). Body half 12 further includes a cover 53 pivotally secured to receptacle 50 by a hinge 52. Cover 53 includes a snap-tab 54 which is forced through aperture 55 (seen in FIG. 3) to secure cover 53 in the closed position shown.

In accordance with the present invention, a toy figure 40 is secured to support surface 31 within body half 11 and is visible outside Yo yo 10. Toy figure 40 defines a recess 42 in the rear portion thereof while support surface 31 defines a post 32. Thus, the attachment of toy figure 40 to support surface 31 is provided by the insertion of post 32 into recess 40. It will be recalled, and as is seen in FIG. 1, that figure accessory 41 includes a rearwardly extending post 26 received within an aperture 27 formed in support surface 31. In the preferred fabrication of the present invention, recess 42 of toy figure 40 is shaped and sized in accordance with post 26 of figure accessory 41 allowing toy figure 40 to receive and support toy figure accessory 41 in a-coupled arrangement shown in FIG. 3.

The attachment of snap-tab 24 to clasp 22 as well as the attachment of snap-tab 54 to clasp 51 is releasable snap attachment which allows cover 20 and cover 53 to be pivoted outwardly in the manner indicated by arrows 43 and 55 respectively. This pivotal movement of covers 20 and 53, corresponds to the opening of Yo yo 10 to provide its alternate play configuration. Yo yo 10 may be returned to the closed position shown in solid line representation in FIG. 2 by simply pivoting covers 20 and 53 in the opposite direction to that indicated by arrows 43 and 55 and thereby forcing snap-tabs 24 and 54 into their respective clasps 22 and 51.

FIG. 3 sets forth a perspective view of Yo yo 10 in its open position corresponding to the play position of the present invention toy. As described above, Yo yo 10 includes a pair of body halves 11 and 12 joined by a shaft 15 (seen in FIG. 2) and forming a string receiving space 13 therebetween. As is also described above, string 14 is received within space 13 and secured to shaft 15 using conventional means of attachment (not shown). Body half 11 includes a receptacle 25 having a snap-clasp 22 which in turn defines an aperture 23. Body half 11 further includes a transparent cover 20 secured in a pivotal attachment to receptacle 25 and maintained in a closed position by a tab 24 received within aperture 23.

Body half 12 includes a receptacle 50 having a clasp 51 formed therein which in turn defines an aperture 55. Body half 12 further includes, a cover 53 pivotally coupled to receptacle 50 by a hinge 52 and having a snap-tab 54 formed therein. Snap-tab 54 cooperates with snap-clasp 51 to secure cover 53 in the closed position shown in FIG. 2. Cover 53 further defines an interior surface having a plurality of play features or topographical features 65. These features include a pair of foot receiving recesses 63 and 64.

In accordance with the anticipated play pattern of the present invention, toy figure 40 having accessory 41 secured thereto in the manner described above is supported upon play surface 62 by the insertion of the toy figure feet within recesses 64 and 65. In further accordance with the play pattern of the present invention, back surface 60 of receptacle 50 defines a plurality of play background features 61.

Thus, in the opened configuration shown in FIG. 3, Yo yo 10 functions to provide a secondary play feature in which a play background environment together with a play surfaces provided for toy figure 40. It will be apparent to those skilled in the art that while toy figure 40 and accessory 41 as well as play background features 61 and play surface 62 are fabricated in accordance with a common "spaceman" theme, other themes and aesthetics may be utilized without departing from the spirit and scope of the present invention. Yo yo 10 is returned to the closed configuration shown in FIG. 2 by removing toy figure 40 from play surface 62 and separating accessory 41 from toy figure 40. Thereafter, cover 20 is opened by forcing tab 24 downwardly and pulling it outwardly from aperture 23 after which toy figure 40 and accessory 41 are replaced upon support surface 31 in the manner shown in FIGS. 1 and 2. Once figure 40 and accessory 41 have been stored within body half 11, cover 53 is returned to the closed position shown in FIG. 2 by pivoting cover 53 upwardly about hinge 52 and forcing snap-tab 54 through aperture 55. Once Yo yo 10 has been returned to its closed position, the user is able to again implement a typical Yo yo play pattern using string 14 as described above.

What has been shown is a Yo yo toy having a pair of body halves which include openable covers and interior cavities for providing additional play activities and for receiving and supporting a toy figure and accessories therefore.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A Yo yo toy comprising:

a first body half having a first receptacle defining a first surface, a first cover and a first hinge pivotally joining said first cover to said first receptacle, said first cover movable between an open configuration and a first closed configuration;

a second body half having a second receptacle defining a second surface, a second cover and a second hinge pivotally joining said second cover to said second receptacle, said second cover movable between an open configuration and a second closed configuration;

a center shaft joining said first and second receptacles to define a space therebetween;

a string having one end wound upon said center shaft and a remaining end being securable to a user's hand or finger;

a toy item; and means for removably securing said toy item against said first surface, said first cover enclosing said toy item in said closed configuration, said first and second bodies, said center shaft, said string and said space being constructed to cooperatively form a yo yo in said first and second closed configurations, wherein said second surface includes a play back surface having play background features and said second cover includes a play surface having play features which in said open configuration cooperate to form a play surface and background for said toy item.

2. The Yo yo toy set forth in claim 1 wherein said toy item is a toy figure.

3. The Yo yo toy set forth in claim 2 wherein said first cover is formed of a transparent material.

* * * * *